United States Patent [19]

Tybie

[11] 4,154,337

[45] May 15, 1979

[54] REFILLABLE MATCHBOOK HOLDER

[76] Inventor: Robert D. Tybie, 1123 SW. Jefferson, Portland, Oreg. 97201

[21] Appl. No.: 883,714

[22] Filed: Mar. 6, 1978

[51] Int. Cl.[2] ..... A24F 27/00

[52] U.S. Cl. ..... 206/118; 206/104

[58] Field of Search ..... 206/105, 122, 104, 111–115, 206/118

[56] References Cited

U.S. PATENT DOCUMENTS

| | | | |
|---|---|---|---|
| 1,573,946 | 2/1926 | Stern | 206/104 |
| 1,588,448 | 6/1926 | Colgate | 206/118 |
| 2,341,856 | 2/1944 | Comee | 206/118 |
| 2,925,906 | 2/1960 | Schoenberger | 206/118 |

FOREIGN PATENT DOCUMENTS

| | | | |
|---|---|---|---|
| 394912 | 12/1908 | France | 206/105 |
| 359199 | 10/1931 | United Kingdom | 206/105 |
| 420173 | 11/1934 | United Kingdom | 206/105 |

*Primary Examiner*—Davis T. Moorehead

*Attorney, Agent, or Firm*—Kolisch, Hartwell, Dickinson & Stuart

[57] ABSTRACT

A refillable matchbook holder having open and closed positions. The holder comprises a single strip of flexible material folded into four segments. Two of the segments are provided with slots for securing matchbooks to the strips, the other two segments being provided with windows permitting access to the match-striking surface of matchbooks. In its closed position, the holder and attached matchbooks form a compact match case, with the two matchbooks facing each other and oriented top to bottom.

5 Claims, 8 Drawing Figures

REFILLABLE MATCHBOOK HOLDER

BACKGROUND AND SUMMARY

The present invention relates to matchbook holders, and more particularly to a refillable matchbook holder designed to contain a pair of matchbooks in compact relationship.

It is common for commercial establishments such as restaurants and the like to distribute, for the convenience of their customers, books of paper stick matches. Such matchbooks are provided for promotional purposes, and as such, usually contain on one or both sides of the matchbook, advertising for the particular establishment.

The use of single matchbooks for promotional purposes has not been wholly satisfactory in that the recipient customer will often use and discard a matchbook within a period of a day or two, thereby limiting the effective advertising period of the matchbook. It is believed that an inexpensive matchbook holder which can be easily refilled with conventional matchbooks would provide greater promotional benefits in that the user could easily refill the holder with fresh matchbooks over the lifetime of the matchbook holder. A refillable matchbook holder having provision for two (or more) matchbooks would be advantageous to the user, in that an additional book of matches would be available when one of the matchbooks is empty.

Heretofore, refillable matchbook holders have been proposed. The present invention in refillable matchbook holders provides the following advantages over such prior art holders:

The matchbook holder is formed by folding a single strip of elongate flexible material, e.g., durable paper, into segments, providing an inexpensive and easily constructed article of manufacture.

The holder is designed to hold a pair of conventional matchbooks, and provide cover access to each matchbook individually.

The holder provides a maximum of space suitable for displaying advertising messages or the like.

The holder provides access to the match-striking surface of the matchbook, whether such striking surface is located on the front or the back side of the matchbook.

To this end, there is provided a matchbook holder which is formed from a single elongate strip of flexible material folded into at least four cover segments. Two of the cover segments have slots, each adapted to receive the back cover of a conventional matchbook, whereby the matchbook is secured to the holder strip. The other two cover segments are provided with rectangular windows, each positioned to provide access to the match-striking surface of the matchbook, which may be located on the front or back cover of the matchbook. The holder has an open position, allowing access to each of the matchbooks individually, and a closed position, in which the matchbooks are held in a compact form with the matchbooks facing each other and oriented top to bottom.

It is, therefore, a primary object of the present invention to provide a novel refillable matchbook holder adapted to hold a pair of conventional matchbooks.

More specifically, it is an object of the present invention to provide a matchbook holder suitable for use in promotional advertising.

Yet another object of the invention is to provide a matchbook holder designed to carry a pair of conventional matchbooks in compact form, and which allows individual access to each of the two matchbooks.

DRAWINGS

These and other objects and features of the present invention will now be more fully described with reference to the following detailed description of the preferred embodiments of the invention and the accompanying drawings, wherein.

DETAILED DESCRIPTION OF PREFERRED EMBODIMENTS OF THE INVENTION

Figure 1:
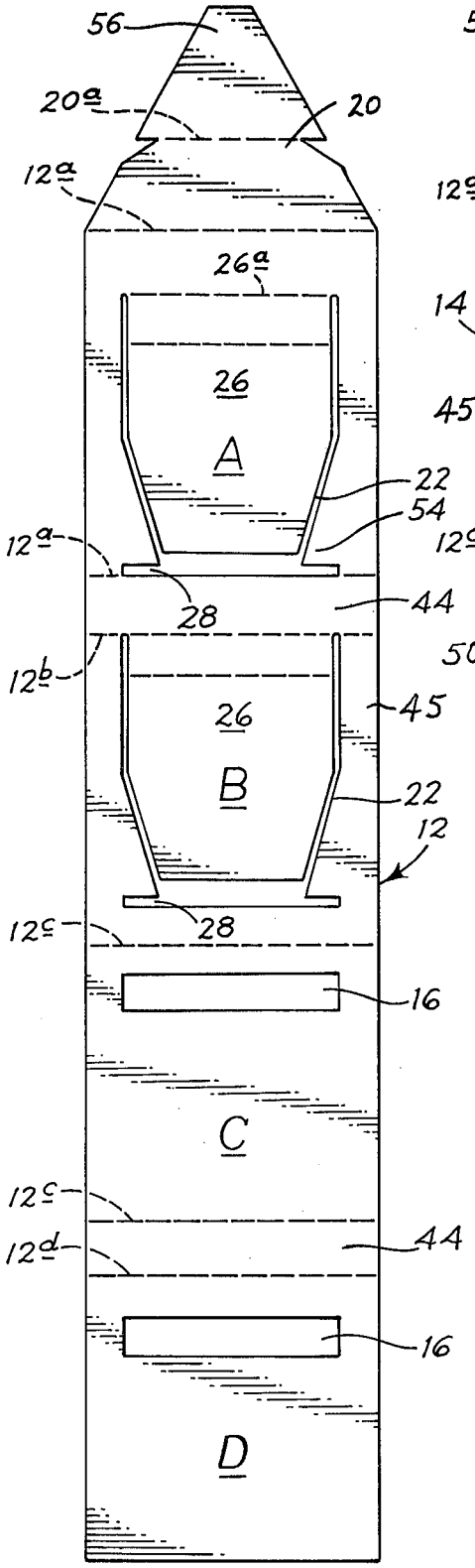
FIG. 1 is a top plan view of the elongate strip used in forming a preferred embodiment of the invention.

Referring now to the figures, and particularly to FIGS. 1–4, there is shown at 10 a preferred embodiment of the present invention matchbook holder having open and closed positions. Holder 10 generally comprises an elongate strip 12 folded along transverse folding lines **12*a*, 12*b*, 12*c*, and 12*d* to form four segments A, B, C and D as shown in FIG. 1. Slot means associated with each segment. A and B are used in securing a conventional book of matches 14 to each segment A and B. Rectangular windows 16** are provided in segments C and D for the purpose described below.

Elongate strip 12 is a flexible strip of material, for example, heavy paper, vinyl, leather, or the like. The strip is formed by cutting a rectangular band to form: a triangular-shaped closure segment 20 adjacent segment A; in each segment A and B, a central cover flap 26 formed by a three-sided cut 22 and bordered at its lower end by a slot 28; and rectangular windows 16 in segments C and D.

Figure 2:
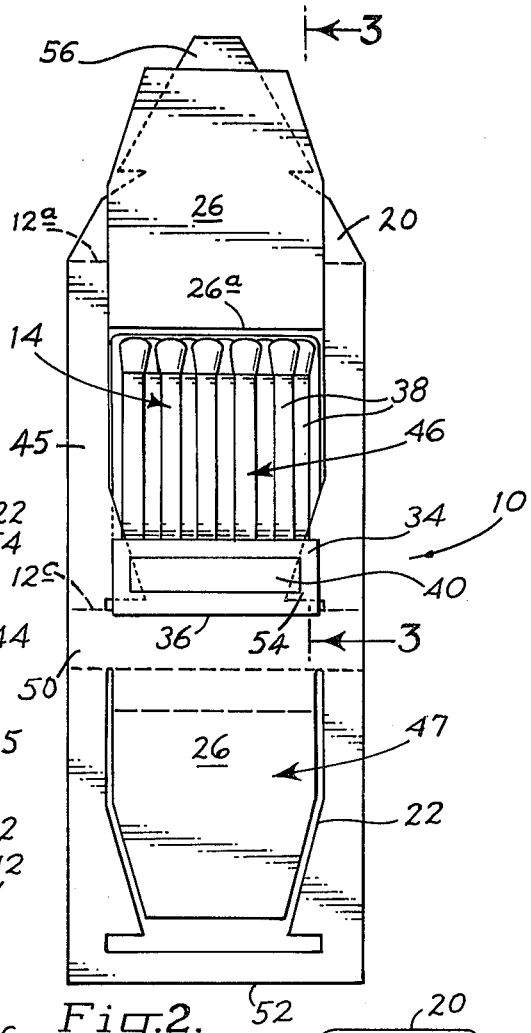
FIG. 2 is a top plan view of the matchbook holder formed by folding the strip of FIG. 1, with the holder in its open position.
Figure 3:
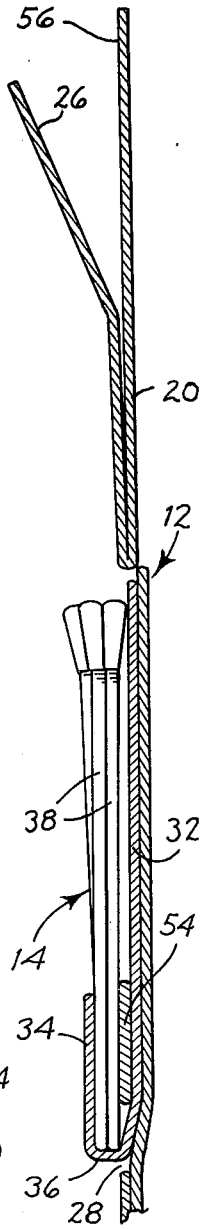
FIG. 3 is a sectional view of the above invention taken generally along line 3–3 of FIG. 2.

Referring to FIGS. 2 and 3, matchbook 14 suitable for use in the present invention includes a back cover, or tongue 32, an upwardly projecting flap 34 connected to the lower end 36 of the tongue, and a plurality of paper matches 38 secured between a portion of the tongue adjacent end 36 and the upwardly projecting flap. A rectangular match-striking surface 40 may be affixed to either the upwardly-projecting flap or to a portion of the tongue adjacent end 36. The above-described matchbook is easily formed from a conventional matchbook by tearing off or otherwise removing the front, or safety cover from a matchbook.

Holder 10 is formed by folding strip 12 along the transverse fold line **12*c* adjacent segment B. With reference to FIGS. 1 and 2, it can be seen that this fold permits alignment of pairs of segments B, C and A, D. Additionally, a pair of spacer strips 44 between segment pairs C, D and A, B are aligned to form a bottom section 50. Following such folding, the rear face of segments D and C are adhesively attached to the adjacent peripheral strip portions 45 of segments A and B, respectively outside cut 22, whereby each cover flap 26 is freely movable about its upper edge 26***a* adjacent the top of the associated cut 22.

The pairs of segments A, D and B, C thus form two matchbook compartments 46, 47 having back covers formed by segments D, C and front covers formed by cover flaps 26 of segments A, B, respectively. The two compartments are separated by bottom section 50.

It can be appreciated from the above that holder 10 may also be constructed from the two strips that would be formed by cutting strip 12 along the line 12*c* adjacent segment B. This is a slight modification of the above described invention in which the bottom end fold 52 of holder 10 is cut transversely.

To load a matchbook compartment with a matchbook 14, the upper edge of matchbook tongue 32 is inserted into slot 28 and the matchbook guided upwardly within the slot until the bottom end 36 of the matchbook is adjacent slot 28. As seen in FIGS. 2 and 3, the tongue of the matchbook is now secured between the compartment back cover and the opposed flaps 54 formed between slot 28 and the opposed, substantially parallel portions of cut 22. Slot means for securing a matchbook to segment A or B thus includes slot 28 and flaps 54. Cover flap 26, which has the approximate dimensions of the original front cover flap removed from the conventional matchbook, can now be folded over the exposed matches and inserted conventionally into the slot between the matches and the upwardly projecting flap 34. Each matchbook held within holder 10 can thus be individually covered by the associated cover flap 26 when the holder is in it open position, shown in FIG. 2.

Figure 4:
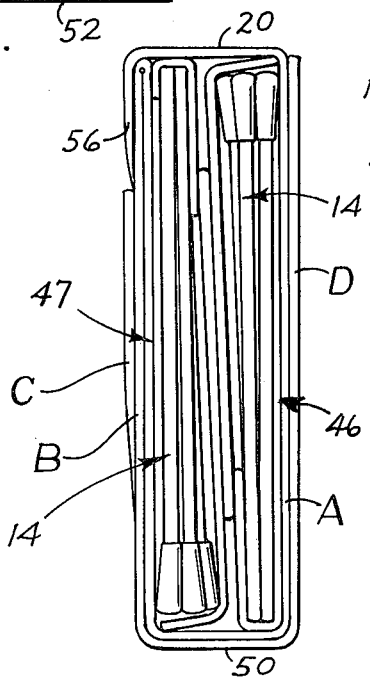
FIG. 4 is a side elevation view of the above invention, showing the holder loaded with two matchbooks in its closed position.
Figure 5:
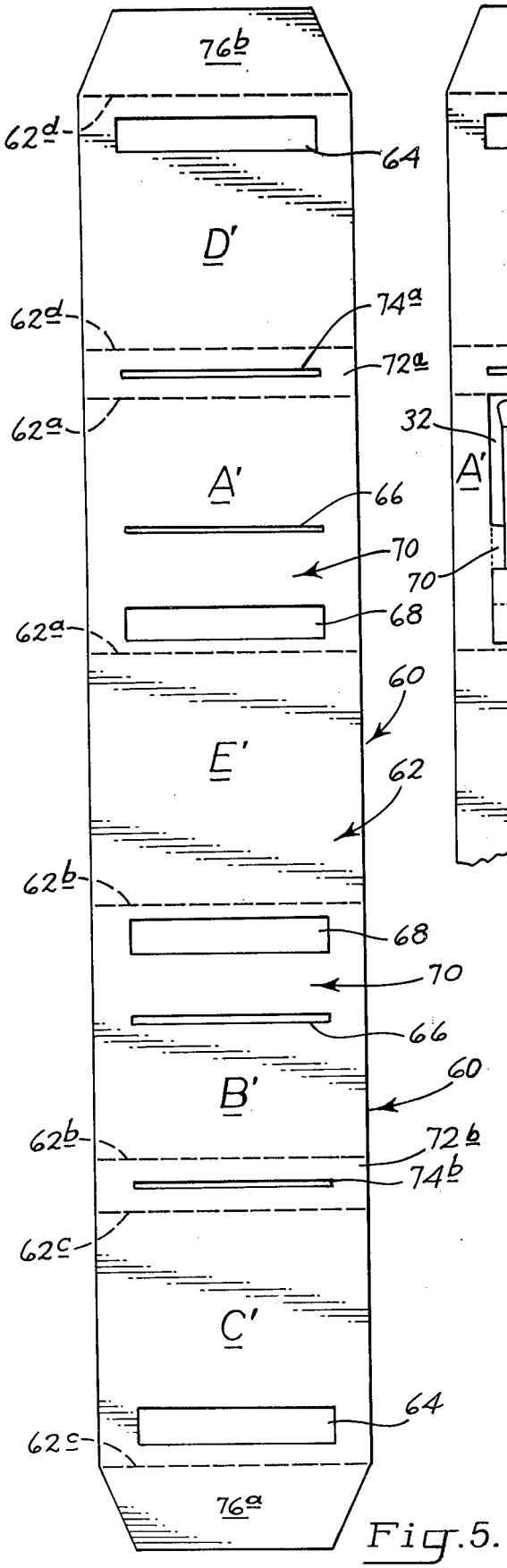
FIG. 5 is a top plan view of an elongate strip used in forming a second embodiment of the invention.

The manner of of using holder 10 will now be described with reference to FIGS. 2 and 4. With the holder in its open position (FIG. 2), a pair of matchbooks are inserted into compartments 46, 47 as described above. If such matchbooks have their match-striking surfaces on the portion of the matchbook tongue adjacent lower end 36, the striking surfaces will be aligned with windows 16, providing access to the striking surface through the back covers of the two compartments. If the match-striking surface is affixed to the upwardly projecting flap of the matchbook, such striking surface will be exposed when the holder is in its open position, as illustrated in FIG. 2. Access to the matches is gained by lifting cover flap 26 away from the matchbook, as shown in FIG. 2.

To secure the loaded matchbook holder in its closed position (FIG. 4), the two compartments are bent upwardly along the two pairs of coincident lines 12*b*, 12*c* and 12*a*, 12*d* defining bottom section 50 thus to form a three-sided structure having upwardly-projecting closure segment 20. Closure segment 20 is then folded downwardly along fold lines 12*a*, 20*a*, and the notched end 56 of segment 20 is tucked into window 16 of segment C. Closure flap 52 and window 16 thus collectively provide closure means for securing the holder in its closed position. As seen in FIG. 4, the matchbooks are facing each other and oriented top-to-bottom in the closed position. It can be further appreciated from FIG. 4 that bottom section 50 and the section of the closure flap 20 between lines 12*a* and 20*a* are dimensioned to span the thickness of a pair of matchbooks so oriented.

Referring now to FIGS. 5–8, there is shown a second embodiment of the present matchbook holder invention in open and closed positions. Holder 60 generally comprises an elongate strip 62 folded along transverse fold lines 62*a*, 62*b*, 62*c* and 62*d* to form four segments A′, B′, C′ and D′, and including an additional segment E′ disposed centrally of the strip. Slot means associated with segments A′ and B′ are used in securing a conventional matchbook to strip 62. Windows 64 formed in segments C′ and D′ provide access to the match-striking surfaces of the matchbook, as described below. Strip 62 is formed by appropriately cutting a band of flexible material such as used in forming strip 12.

Figure 6:
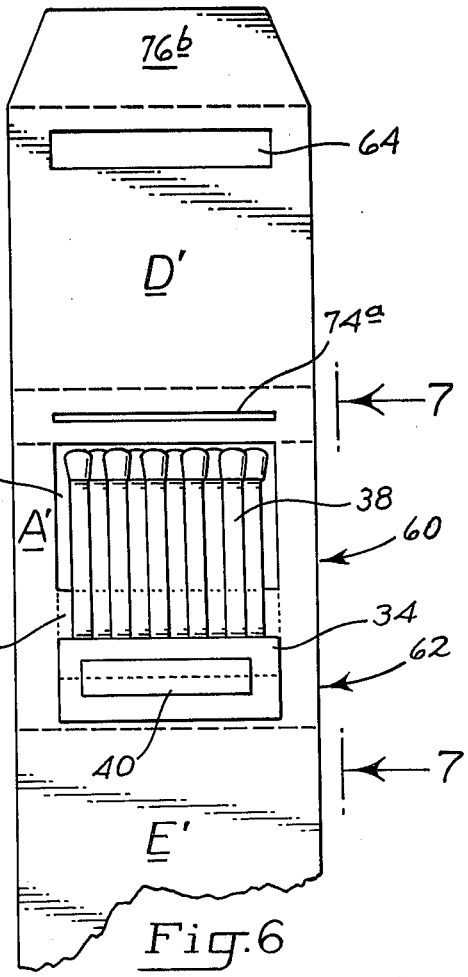
FIG. 6 shows the upper portion of the elongate strip of FIG. 5, having a matchbook secured thereto.
Figure 7:
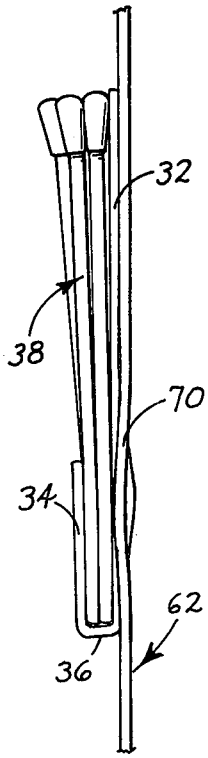
FIG. 7 is a side elevation view of the second embodiment of the invention taken generally along line 7—7 of FIG. 6.

The slot means associated with each segment A′ and B′ generally comprises a laterally-extending slot 66 and a rectangular window 68 extending substantially parallel to and coextensive with slot 66. A matchbook is secured to segment A′ or B′ by inserting the matchbook tongue 32 into window 68 and up through slot 66, whereby the lower portion of the tongue is held by the band 70 between the slot and the window, as shown in FIG. 6. So secured and positioned, the matchbook has its striking surface 40 vertically-aligned with the associated window 68.

Also included in strip 62 are a pair of spacer segments 72*a* and 72*b*, spacing apart segment pairs A′, D′, and B′, C′, respectively. Within each segment 72*a*, 72*b*, are laterally extending tab slots 74*a* and 74*b*, also referred to herein as first and second tab slots, respectively. End tabs 76*a* and 76*b*, also referred to herein as first and second end tabs, adjacent the free ends of segments C′, D′, interlock with first and second tab slots 74*a*, 74*b*, respectively, to form closure means for securing the holder 60 in a closed position, as described below.

A first matchbook is secured to segment A′ as described above. A second matchbook is secured to segment B′ similarly, by inserting the upper end of matchbook tongue 32 into the associated window 68 and down through the associated slot 66. The two matchbooks are then secured to the strip with their lower ends 36 facing. In this configuration, the strip holder is in its open position.

Figure 8:
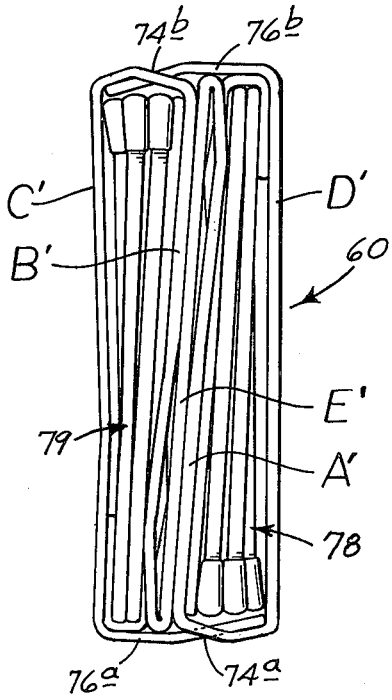
FIG. 8 is a side elevation view of the second embodiment of the invention, showing the holder loaded with two matchbooks in its closed position.

Preparatory to closing holder 60, strip 62 is folded along transverse fold lines 62*a*, 62*b*, 62*c*, and 62*d* with segments A′–E′ folded in accordian fashion, as seen in FIG. 8. Segment pairs D′, A′ and B′, C′ form a matchbook compartments 78, 79 having bottom covers A′, and B′ and top covers D′, and C′, respectively. Segment E′, sandwiched between segments A′ and B′, separates the two compartments. In this configuration, windows 66 are aligned with windows 64, whereby windows 64 may provide access to the match-striking surfaces located on matchbook flaps 34.

Holder 60 is then closed, as indicated above, by engaging first tab 76*a* in first tab slot 74*a*, and second tab 76*a*, in second tab slot 74*a*, as shown in FIG. 8. Thus, to obtain access to the matchbooks held within one of the compartments 78, 79 one of tabs 76*a* or 76*b* is disengaged from the associated tab slot 74*a* or 74*b*.

Two embodiments of a matchbook holder which are easily and inexpensively constructed, durable, and easily used and refilled for extended use have been disclosed. Various modifications and changes of the invention may be made without departing from the spirit of the invention as set forth in the appended claims.

It is claimed and desired to secure by Letters Patent:

1. A refillable matchbook holder having opened and closed positions, comprising an elongate strip of flexible material folded along transverse fold lines to form four segments A, B, C and D, with segments D and C being adhesively secured to said segments A and B, respectively, and each pair of segments A, D and B, C forming a matchbook compartment, slot means associated with each segment A and B for securing a matchbook to the associated matchbook compartment, and closure means for securing the holder in its closed position wherein a matchbook secured to one of said compartments faces a matchbook secured to the other of said compartments.

2. The holder of claim 1 wherein a cover flap formed in each segments A and B provides a front cover for the associated matchbook compartment.

3. A refillable matchbook holding having opened and closed positions, comprising an elongate strip of flexible material folded along transverse fold lines to form four segments A, B, C and D, and a fifth segment E disposed centrally of said strip, with segment pairs A, D and B, C each forming a matchbook compartment separated by segment E when said holder is in its closed position, slot means associated with each of segments A and B for securing a matchbook to the associated matchbook compartment, and closure means for securing the holder in its closed position wherein a matchbook secured to one of said compartments faces a matchbook secured to the other of said compartments.

4. The holder of claim 3 wherein said D and C segments have free end portions, and said closure means includes first and second tab slots disposed between said segments A and D and said segments B and C, respectively, and first and second tabs attached to said free end portions of said segments C and D, respectively, for engaging first and second tab slots, respectively.

5. A refillable matchbook holder having opened and closed positions, comprising a piece of flexible material folded to form five segments A, B, C, D and E, with segment pairs D, A and C, B, each forming a matchbook compartment separated by segment E when said holder is in its closed position, slot means associated with said segments A and B for securing a matchbook to the associated compartment, and closure means for securing the holder in its closed position wherein a matchbook secured to one of said compartments faces a matchbook secured to the other of said compartments.

* * * * *